US005328088A

United States Patent [19]

Lonczak

[11] Patent Number: 5,328,088

[45] Date of Patent: Jul. 12, 1994

[54] NEWSPAPER TRANSPORT PACK

[76] Inventor: John Lonczak, 14 Park Pl., Newburgh, N.Y. 12550

[21] Appl. No.: 24,363

[22] Filed: Mar. 1, 1993

[51] Int. Cl.[5] ..... B65D 5/10

[52] U.S. Cl. ..... 229/157; 100/34; 100/912; 229/117.01; 229/185

[58] Field of Search ..... 229/40, 156, 157, 185, 229/117.01, 117.05; 100/34, 912

[56] References Cited

U.S. PATENT DOCUMENTS

| | | | |
|---|---|---|---|
| 2,361,603 | 10/1944 | Cohen et al. | 229/185 |
| 2,594,394 | 4/1952 | Casselman et al. | 229/117.01 |
| 2,680,556 | 6/1954 | Currie | 229/117.01 |
| 2,787,409 | 4/1957 | Vogt | 229/157 |
| 2,970,741 | 2/1961 | Stone et al. | 229/157 |
| 2,973,129 | 2/1961 | Stone et al. | 229/157 |
| 3,119,546 | 1/1964 | Wuerthner | 229/40 |
| 3,344,971 | 10/1967 | Walker | 229/117.01 |
| 4,291,827 | 9/1981 | Mulroy | 229/156 |
| 4,367,840 | 1/1983 | McFadden | 229/157 |
| 5,004,099 | 4/1991 | Carpenter et al. | 100/912 |
| 5,046,662 | 9/1991 | Cowles | 229/157 |
| 5,104,035 | 4/1992 | Rosenbaum, II | 229/156 |
| 5,150,646 | 9/1992 | Lonczak | 100/34 |

FOREIGN PATENT DOCUMENTS

| | | | |
|---|---|---|---|
| 452442 | 5/1950 | Italy | 229/157 |

*Primary Examiner*—Gary E. Elkins
*Attorney, Agent, or Firm*—Michael Ebert

[57] ABSTRACT

A carton of recyclable material adapted to receive a stack of discarded newspapers to create a transport pack which can, in toto, be recycled at a recycling facility. The carton is formed by a pair of side walls having upper and lower foldable long flaps, and a pair of end walls having upper and lower foldable short flaps. Formed at the corners of the long flaps are latching tongues that are insertable into corresponding slots at the ends of the short flaps. The end walls are accordion-foldable, whereby the carton may be collapsed into a flattened storage state. To put the carton into its loading state, the carton is expanded, the lower short flaps are folded in and the lower long flaps are folded thereover, the latching tongues being then inserted in the slots at the lower corners of the carton to form a bottom ledge on which the newspapers are piled. When the carton is stacked with newspapers, it is put in its pack state by folding in the upper short flaps and folding the upper long flaps thereover, the latching tongues being then inserted in the slots at the upper corners of the carton to form a cover ledge locking the stack within the carton.

6 Claims, 2 Drawing Sheets

T
10U
T
F4
F3
10
T
10L
11L
T

11U
F2
F3
13
11
12U
10
10U
F4
T
F2
12
10L
F1
T
12L

T
S
13
F3
13U
F5
11
11U
10U
F2
F4
12U
F3
11L
F5
10
12
F2
T
F1
S
10L
F6
F4
T
12L

13L
T
F6
S
11L
F2
11
10L
12L
10
12
F2
S
12U
10U
T

S
13L
T
F4
11L
10L
12L
10
F4
T
12
F2
S
10U
12U
T

NEWSPAPER TRANSPORT PACK

BACKGROUND OF INVENTION

1. Field of Invention

This invention relates generally to forming a bundled stack of discarded newspapers so that they can be transported to a recycling facility, and more particularly to a carton adapted to receive a stack of newspapers to form a transport pack which can, in toto, be recycled at the facility.

2. Status of Prior Art

Environmental protection and the avoidance of waste are now matters of national concern. As a consequence, households in most communities throughout the United States are no longer permitted to treat discarded newspapers as trash to be commingled with garbage. It is now generally mandated that after daily newspapers have served their purpose, they must be stacked and bundled so that they can be picked up at the end of the week or at some other interval by a municipal recycling agency.

Newspapers are printed on long paper sheets which are folded in half to produce four pages. A standard newspaper has a page size of about 14 by 22 inches, whereas the page size of a tabloid is about 14 by 11 inches. However, while a tabloid is delivered to its readers in an unfolded state, the standard newspaper is composed of several sections, each being folded in half. Hence the rectangular dimensions of a standard folded newspaper are about the same as those of an unfolded tabloid. Because of this, tabloids and standard newspapers lend themselves to stacking in the same pile.

After a newspaper has been read by members of a household, it is often generally then in disarray. If, therefore, the newspapers are to be saved for recycling, they must be restored to a somewhat orderly state so that they can be handled in bulk. But if the newspapers to be recycled are stored, say, in a closet or in a basement, it becomes troublesome to produce an orderly pile. As one stacks the papers accumulated in a given day over those laid down from previous days, unless care is exercised, one does not usually succeed in avoiding disarray, for as the pile grows in height, the newspapers are then often askew. This makes it difficult when the time comes to bundle the stack to encircle the stack with a tying cord.

Moreover, a stack of loose newspapers may create a somewhat hazardous condition in the typical household, for loose papers may be blown off the stack by a draft. And if the papers are stacked in a kitchen having a gas-fueled stove, these papers may catch on fire. Quite apart from these considerations is the fact that an exposed pile of newspapers in a kitchen, basement or elsewhere in the household is untidy. Thus while it is the common practice to collect household garbage in plastic trash bags which are concealed in attractive containers having a pivoted lid, there is no equivalent device for newspapers.

To facilitate the stacking and bundling of discarded newspapers, my prior U.S. Pat. No. 5,150,646 discloses a form in which newspapers to be recycled may be piled to create a stack thereof which is then tied into a bundle which can be removed from the form and transported as a bundle to a recycling facility.

This form is composed of a pair of complementary sections whose dimensions are such as to accommodate folded standard newspapers and unfolded tabloids.

Each section of the form is created from a cardboard blank that is scored, slotted and die cut to define a side wall and major and minor end walls at right angles thereto, each of these walls having a fold-in bottom flap. Projecting from the minor end wall is a locking tongue and cut into the major end wall is a slot to receive a locking tongue.

To assemble the form, the sections are placed in opposing relation with their minor and major end walls overlapped, the locking tongue of one section being received in the slot of the other section. In its assembled state, the fold-in flaps of the walls are overlapped at the corners of the form to maintain its rectangular shape. Keyhole slots at the upper edges of the form serve to hold the ends of two cords, one extending longitudinally along the bottom of the form below the papers to be stacked therein and the other extending transversely. After the form is loaded with a pile of stacked papers, the cords are withdrawn from their keyhole slots and tied to bundle the pile which can then be removed from the form.

While my patented form is effective for its intended purpose, it suffers from practical drawbacks which militate against its widespread adoption. It is not only necessary for the user to set up the form by joining together two complementary sections, but before the form can be put to use, the ends of two cords must be inserted into keyhole slots so that the newspapers can then be piled onto the cords which extend along the bottom of the form.

And when the form is loaded with newspapers, the user must then remove the ends of the cords from the keyhole slots and tie them into knots to form a bundle which must then be removed from the form.

While this procedure entails no particular skill, it is bothersome to many users. Moreover, the user must keep in stock, not only the cardboard sections for creating forms, but also cords of the proper length for the bundling of the stack.

SUMMARY OF INVENTION

In view of the foregoing, the main object of this invention is to provide a carton made of recyclable material which is adapted to receive a stack of discarded newspapers to form a transport pack that can, in toto, be recycled at a recycling facility.

A significant feature of the invention is that no cords, sealing tape or other non-recyclable expedients are required to create the transport pack.

More particularly, an object of the invention is to provide a collapsible carton of the above type which in its storage state is in a flattened condition, in its expanded loading state it then has a bottom ledge onto which newspapers may be piled to form a stack, and which in its pack state it then has a cover ledge which locks the stack within the carton so that the loaded pack is self-sufficient and can be transported to a recycling facility.

One advantage of the invention is that the carton in its collapsed, flattened storage state occupies little space, and the user, therefore, may keep in stock a large supply of such cartons. Another advantage of the invention is that the carton in its loading state conceals and confines the pile of accumulated newspapers stacked therein, so that the papers will not be blown away, as might happen if they were not confined and simply laid down in a loose file.

Also an object of the invention is to provide a carton of the above type that can be mass-produced by simple die-cutting operations so that the cartons can be sold at a low cost to users.

Briefly stated, these objects are attained in a carton of recyclable material adapted to receive a stack of discarded newspapers to create a transport pack which can, in toto, be recycled at a recycling facility. The carton is formed by a pair of side walls having upper and lower foldable long flaps, and a pair of end walls having upper and lower foldable short flaps. Formed at the corners of the long flaps are latching tongues that are insertable into corresponding slots at the ends of the short flaps. The end walls are accordion-foldable, whereby the carton may be collapsed into a flattened storage state. To put the carton into its loading state, the carton is expanded, the lower short flaps are folded in and the lower long flaps are folded thereover, the latching tongues being then inserted in the slots at the lower corners of the carton to form a bottom ledge on which the newspapers are piled. When the carton is stacked with newspapers, it is put in its pack state by folding in the upper short flaps and folding the upper long flaps thereover, the latching tongues being then inserted in the slots at the upper corners of the carton to form a cover ledge locking the stack within the carton.

BRIEF DESCRIPTION OF DRAWINGS

For a better understanding of the invention as well as other objects and further features thereof, reference is made to the following detailed description to be read in conjunction with the accompanied drawings, wherein.

DESCRIPTION OF INVENTION

Figure 1:
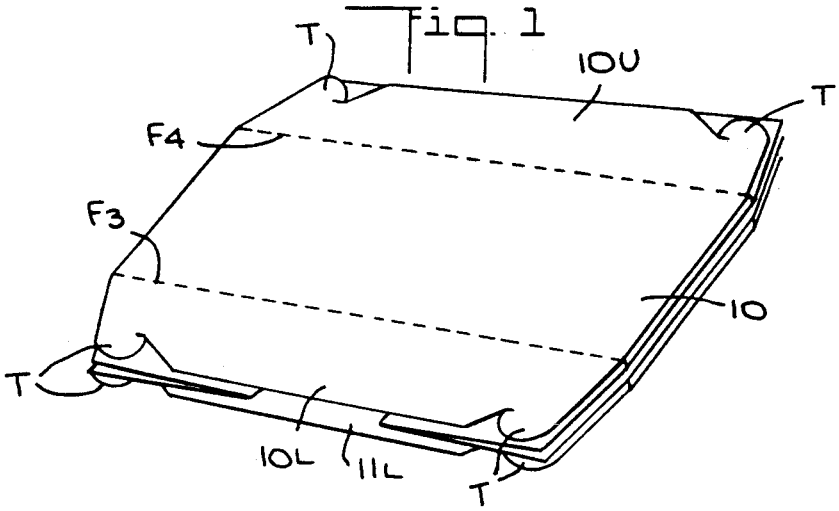
FIG. 1 shows a carton in accordance with the invention adapted to contains a stack of newspapers piled therein to form a transport pack, the carton being shown in its collapsed, storage state.

A carton in accordance with the invention illustrated in the drawings is made entirely of inexpensive cardboard or other cellulosic material which is capable of being recycled in a newspaper recycling facility. In the facility, the discarded material to be recycled is fed into a beater where it is shredded preparatory to forming a slurry to be processed. The cellulosic material being processed in this facility must be free of synthetic plastic, metal staples or any other non-cellulosic material.

A carton in accordance with the invention includes no plastic sealing tapes, metal staples or other substances which are not acceptable to a paper recycling facility. Indeed, the carton itself may be fabricated of recycled paper.

Figure 2:
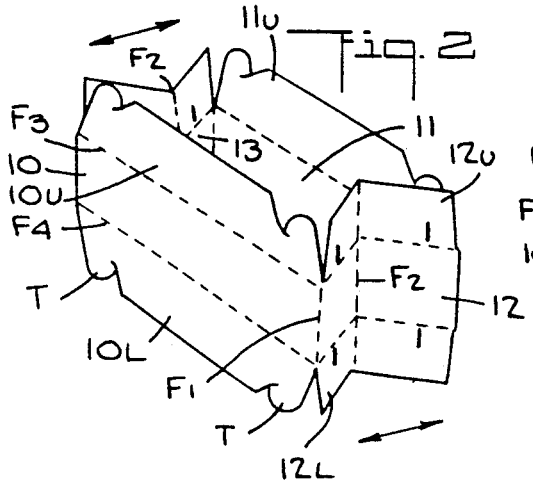
FIG. 2 illustrates the carton as it is being expanded in preparation to being put into its loading state.

FIG. 1 illustrates the carton in its collapsed, flattened storage state in which it may be stored. In order to erect the flattened carton to put it in its loading state in which it can be loaded with discarded newspapers to be recycled, the carton must be expanded. FIG. 2 the carton in the course of being expanded and FIG. 3 the carton in its fully expanded state in which it has a rectangular form and is fully open at the top and bottom.

The carton is made up of two identical blanks which are scored to provide the required fold lines and are die cut to provide the required tongues, notches, slots, and other features of the carton. The two blanks are joined together by adhesive flaps to create a rectangular form.

Thus while the carton has been disclosed as being adapted to accommodate a stack of newspapers, the invention is not limited to this application. In practice, the carton may be dimensioned to receive paper waste generated in offices and other paper handling facilities. Typical of such waste are Xerox copy papers, legal and standard size paper sheets, and magazines. When such paper waste is stacked in a carton, the resultant pack may, in toto, be recycled in a paper recycling facility.

The carton includes a pair of side walls 10 and 11, and a pair of end walls 12 and 13 hinged to the side walls at transverse fold lines $F_1$. End walls 12 and 13 are each divided by a transverse fold line $F_2$ into two half sections to define an accordion fold which, when the carton is collapsed, as shown in FIG. 1, folds in to cause side walls 10 and 11 to come together, thereby flattening the carton.

Longitudinal fold lines $F_3$ scored in side walls 10 and 11 define long, foldable upper flaps 10U and 11U. Longitudinal fold lines $F_4$ scored in side walls 10 and 11 in parallel with fold lines $F_3$ define long, foldable lower flaps 10L and 11L. Longitudinal fold lines $F_5$ scored in end walls 12 and 13 in alignment with fold lines $F_3$ define short, foldable upper flaps 12U and 13U. And longitudinal fold lines $F_6$ scored in end walls 12 and 13 in alignment with fold lines $F_4$ define short, foldable lower flaps 12L and 13L.

Figure 6:
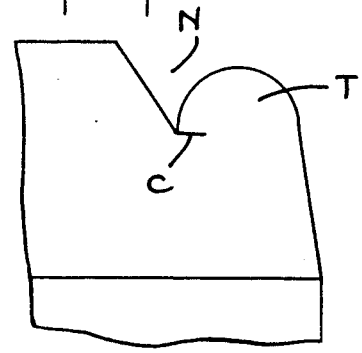
FIG. 6 separately shows one of the latching tongues at a corner of a long flap of the carton.

The long upper flaps 10U and 11U and the long lower flaps 10L and 11L at the carton are each provided at the opposite corners of the flap with a rounded latching tongue T which, as best seen in FIG. 6, merges with a triangular notch N, a short cut C extending from the apex of the notch into the base of the tongue.

The short upper flaps 12U and 13U, and the short lower flaps 12L and 13L of the carton are each provided at opposite ends with a slot S whose length is somewhat greater than the width of the base of the tongue, so that the tongue is easily inserted therein.

Figure 7:
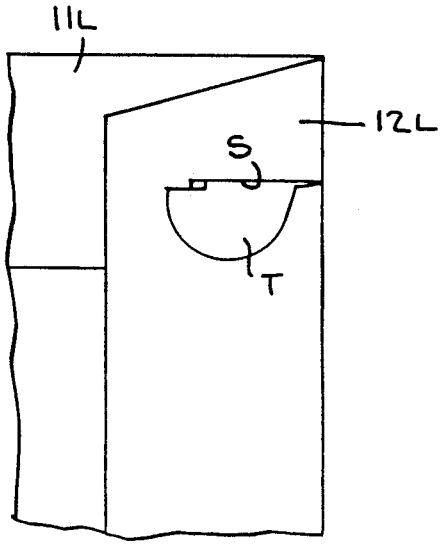
FIG. 7 shows the tongue inserted in a complementary slot at the end of a short flap of the carton.

When, as shown in FIG. 7, a short flap, such as lower flap 12L is folded in so that it is then at right angles to its end wall, and long lower flap 11L is then folded in to overlie the short flap at a corner of the carton, tongue T in the long flap is then inserted in slot S in the short flap to latch the flaps together.

The reason why latching takes place is that when tongue T is fully inserted in slot S, because the cut C in the base of the tongue is now in line with slot S, a slight lateral displacement of the tongue will cause it to shift sideways to an extent limited by the length of the cut. As a result, the tongue is now offset with respect to the slot and cannot be withdrawn therefrom.

Figure 3:
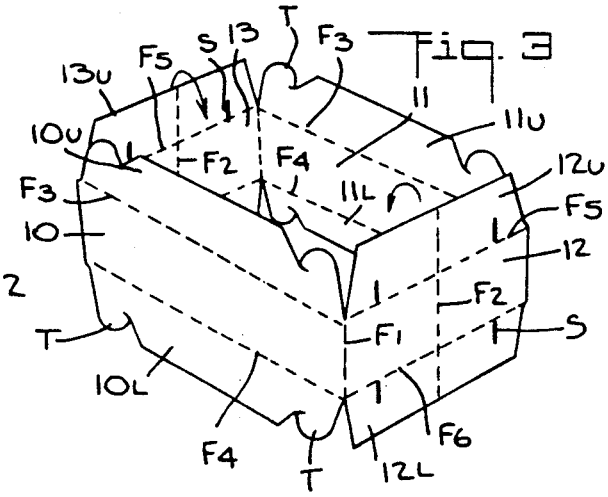
FIG. 3 shows the fully expanded carton.

Before the fully expanded carton shown in FIG. 3 can be loaded with discarded newspapers, it must be put in its loading state in which a bottom ledge is formed in the carton on which the papers can be piled.

The newspapers to be stacked in the carton are standard folded papers whose rectangular dimensions are about 14 by 11 inches as well as unfolded tabloids having about the same dimensions. The rectangular dimensions of the box are such as to accommodate these papers as they accumulate and in doing so create a tidy stack. Thus the carton rectangular dimensions are about 14½ by 11⅜ inches with a depth of about 4 inches, which is usually sufficient for a week's accumulation of papers.

Figure 4:
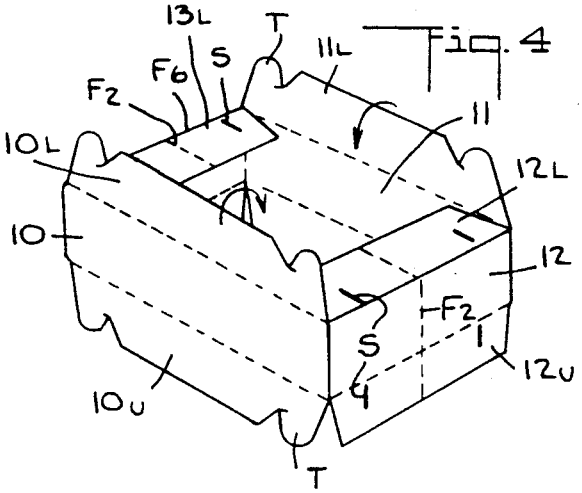
FIG. 4 shows the first step in forming a bottom ledge on the carton so that it is loadable.
Figure 5:
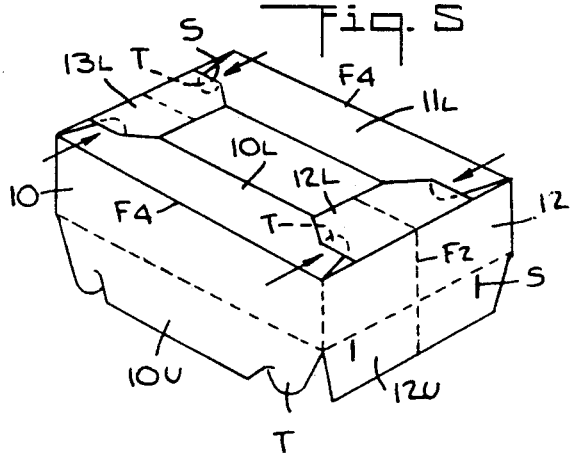
FIG. 5 shows the second and final step in forming the bottom ledge.

In order to form the bottom ledge, the expanded carton shown in FIG. 4 is turned upside down, and the short lower flaps 12L and 13L are folded in. Then, as shown in FIG. 5, the long lower flaps 10L and 11L are folded in, the latching tongues T of the long flaps being then inserted in slots S in the short flaps to latch the corners of the base ledge.

Figure 8:
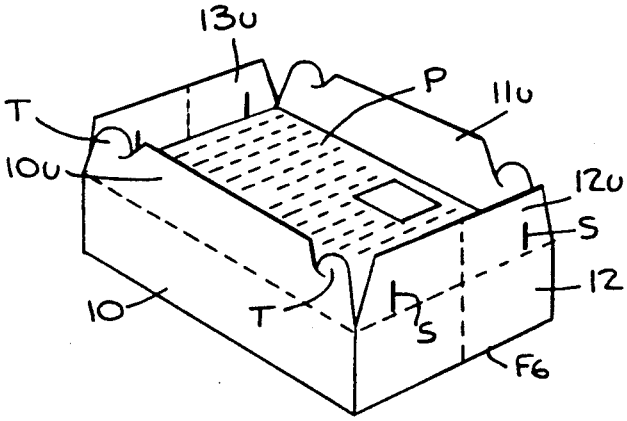
FIG. 8 shows the carton in its loading state loaded with a stack of discarded newspapers.

Now that a bottom ledge has been created, the carton is in its loading state and is in a condition to be loaded with discarded newspapers as they accumulate. FIG. 8 shows the carton fully loaded with newspapers which are stacked in the carton up to its top. In the loading state, the short upper flaps 12U and 13U and the long upper flaps 10U and 11U are upright to afford full access to the interior of the carton.

Figure 9:
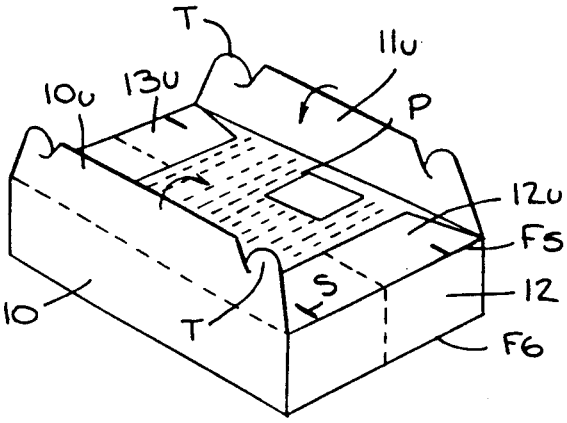
FIG. 9 shows the first step in forming a cover ledge on the carton to put it in its pack state.

Then in order to put the carton in its finished packed state, a cover ledge must be created to lock in the stack of newspapers. The first step in forming the cover ledge is to fold in the short upper flaps 12U and 13U, as shown in FIG. 9. Then, as shown in FIG. 10, the long upper flaps 10U and 11U are folded in and latched by their tongues T to the short flaps at the corners of the carton.

Figure 10:
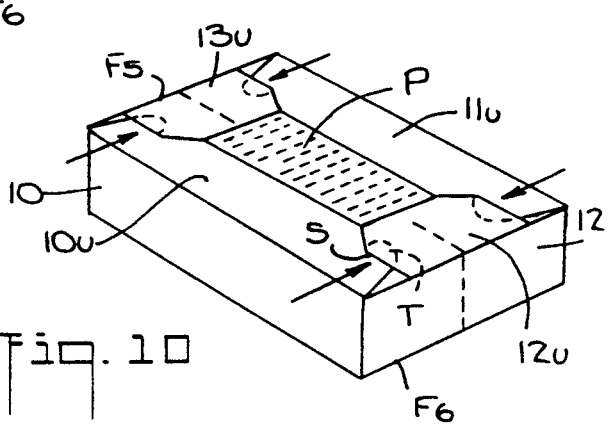
FIG. 10 shows the final step in forming the cover ledge.

The pack shown in FIG. 10 can be transported to a paper recycling facility and deposited, as is, into the beater stage of this facility. Since the newspapers contained in the carton and the carton itself are all of cellulosic material, and the pack includes no sealing tape, staples or other non-cellulosic material, the entire pack can be recycled.

The dimensions of the carton are such that when a loaded pack is formed, its weight does not exceed 10 pounds, for heavier packs may be difficult for a typical householder to handle. The usual practice in most suburban communities is to have pick-ups once a week for discarded newspapers to be recycled. The capacity of the carton is sufficient for a weeks accumulation of newspapers in a typical household. However, if necessary, more than one carton may be used to accommodate a large accumulation of papers.

While there has been shown and described a preferred embodiment of a newspaper transport pack in accordance with the invention, it will be appreciated that many changes and modifications may be made therein without, however, departing, from the essential spirit thereof.

I claim:

1. The combination of a carton with a stack of discarded newspapers to create a transport pack, comprising:

(a) a pair of side walls having relatively narrow upper and lower foldable long flaps provided with corner latching tongues;

(b) a pair of end walls at right angles to the side walls having relatively narrow upper and lower foldable short flaps provided with end slots into which are insertable the latching tongues, whereby to put the carton in a loading state, to receive newspapers the lower short flaps are folded in and the lower long flaps are folded thereover, the latching tongues of the lower long flaps then being inserted in the end slots of the lower short flaps to create a bottom ledge surrounding a rectangular window on which the stack of newspapers is piled, and to put the carton in a pack state, the upper short flaps are folded in and the upper long flaps are folded thereover, the latching tongues of the upper long flaps then being inserted in the end slots of the upper short flaps to create a cover ledge surrounding a rectangular window and locking the stack within the carton, the carton having rectangular dimensions that are substantially equal to those of the newspapers received therein.

2. The combination as set forth in claim 1, wherein the carton is formed of recyclable material, whereby the pack may in toto be recycled in a paper recycling facility.

3. The combination as set forth in claim 2, in which the carton is formed of cardboard.

4. The combination as set forth in claim 1, wherein each of said end walls is provided with a score line to divide it into an accordion fold, whereby the carton is collapsible and in a storage state is flattened.

5. The combination as set forth in claim 1, wherein each of said latching tongues at the corner of a long flap merges with a triangular notch, and is provided with a cut that extends from an apex of the notch into a base of the tongue.

6. The combination as set forth in claim 5, wherein said end slot is slightly longer than the base of the tongue, whereby when the tongue is inserted in the slot and is displaced so that the cut extends from one end of the slot, the tongue is then locked into the slot.

* * * * *